US008637798B2

(12) United States Patent
Rastegar

(10) Patent No.: US 8,637,798 B2
(45) Date of Patent: Jan. 28, 2014

(54) INTEGRATED REFERENCE SOURCE AND TARGET DESIGNATOR SYSTEM FOR HIGH-PRECISION GUIDANCE OF GUIDED MUNITIONS

(75) Inventor: Jahangir S. Rastegar, Stony Brook, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 42 days.

(21) Appl. No.: 13/316,553

(22) Filed: Dec. 11, 2011

(65) Prior Publication Data

US 2012/0262334 A1 Oct. 18, 2012

Related U.S. Application Data

(63) Continuation-in-part of application No. 12/550,399, filed on Aug. 30, 2009, now Pat. No. 8,076,621.

(60) Provisional application No. 61/094,900, filed on Sep. 6, 2008.

(51) Int. Cl.

| | |
|---|---|
| ***F41G 7/00*** | (2006.01) |
| ***F42B 15/01*** | (2006.01) |
| *F42B 15/00* | (2006.01) |

(52) U.S. Cl.

USPC ..... 244/3.1; 342/61; 342/62; 244/3.11; 244/3.14; 244/3.15; 244/3.19

(58) Field of Classification Search

USPC ..... 342/61, 62; 244/3.1–3.3; 89/1.11; 343/700 R, 705, 708, 745, 746, 767, 343/770, 771; 701/400, 408, 468

See application file for complete search history.

(56) References Cited

U.S. PATENT DOCUMENTS

| | | | | |
|---|---|---|---|---|
| 6,307,514 | B1 * | 10/2001 | West | 343/705 |
| 6,606,072 | B1 * | 8/2003 | Hayward et al. | 343/767 |
| 6,724,341 | B1 * | 4/2004 | Pereira et al. | 342/62 |
| 7,121,502 | B2 * | 10/2006 | Krikorian et al. | 244/3.14 |
| 7,193,556 | B1 * | 3/2007 | Pereira et al. | 342/62 |
| 8,076,621 | B2 * | 12/2011 | Rastegar et al. | 244/3.1 |
| 8,077,099 | B1 * | 12/2011 | Wesh et al. | 343/705 |
| 8,093,539 | B2 * | 1/2012 | Rastegar | 244/3.19 |
| 8,138,982 | B1 * | 3/2012 | West et al. | 343/705 |

* cited by examiner

*Primary Examiner* — Bernarr Gregory

(57) ABSTRACT

A method for determining a position of a device in a reference coordinate system. The method including: receiving, at the device, less than all of GPS signals necessary to determine the position of the device in the reference coordinate system; transmitting a signal from av illuminating source defined in the reference coordinate system; receiving the signal at a cavity waveguide disposed on the device; and determining the position of the device in the reference coordinate system based on the GPS signals and the signal received in the cavity waveguide. The signal received in the cavity waveguide can also be used to confirm a position determined by the GPS signals.

10 Claims, 3 Drawing Sheets

INTEGRATED REFERENCE SOURCE AND TARGET DESIGNATOR SYSTEM FOR HIGH-PRECISION GUIDANCE OF GUIDED MUNITIONS

CROSS-REFERENCE TO RELATED APPLICATIONS

This application is a Continuation-In-Part application of U.S. application Ser. No. 12/550,399, filed on Aug. 30, 2009, now U.S. Pat. No. 8,076,621, which claims benefit to U.S. Provisional Application No. 61/094,900 filed on Sep. 6, 2008, the entire contents of each of which is incorporated herein by reference.

This application is related to U. S. Pat. Nos. 6,724,341 and 7,193,556; U.S. Patent Application Publication No. 2007/0001051 and U.S. patent application Ser. No. 11/888,797 filed on Aug. 2, 2007, now U.S. Pat. No. 8,164,745, and Ser. No. 12/191,295 filed on Aug. 13, 2008, now U.S. Pat. No. 8,259,292, the entire contents of each of which is incorporated herein by reference.

BACKGROUND OF THE INVENTION

1. Field of the Invention

The present invention relates generally to reference sources and target designator systems, and more particularly, to integrated reference source and target designator systems for high-precision guidance of guided munitions.

2. Prior Art

In general, a human or machine (such as an "Unmanned Aerial Vehicle" (UAV), or an "Unmanned Ground Vehicle" (UGV) or a manned aerial or ground vehicle, or the like) is used to identify a target. Some means (e.g., one or more of the systems and devices such as "Global Positioning System" GPS, range finders, inertial devices, etc.) are then used to determine the position of the target and other relevant target indication information. Hereinafter, the above human or machine that is used to determine the position of the target is referred to generally as the "forward observer".

In general, the position of the target is determined by the "forward observer" and is indicated relative to the earth. The "forward observer" must also determine its own position relative to the earth. The weapon platform that is to engage the target must also know its own position relative to the earth. The target position and other information that is acquired by the "forward observer" is then passed to the engaging weapon platform fire controller (usually a computer), which would then perform proper computations and pass target position and other guidance and control information to the guided munitions that is to be launched against the designated target. Once launched, the guided munitions will use the target position information (and sometimes target position updates when it is available) to guide itself to the designated target position. Near the target, guided munitions may, when equipped with some type of homing sensors, also use the latter sensors to guide them to the target.

As indicated above, in most current munitions guidance and control systems, the position of the target is determined by the forward observer relative to the earth, i.e., the earth is considered to be the reference system in which the position of the target, the weapon platform, and the forward observer is defined. In addition, the guided munitions, such as a projectile fired from a gun or a mortar shell, monitors its position relative to the same earth based (fixed) position reference system. There is, however, a positioning error relative to each one of the above four position measurements relative to the earth fixed position reference system. As a result, the four position error measurements add up to make up the amount of positioning error that the guided munitions will have relative to the target that it is desired to intercept, leading to a significant degradation of the precision with which a target could be intercepted.

In general, the only method available for increasing the precision with which guided munitions can be guided to intercept the target is by providing some type of homing device. Such homing systems may, for example, include target seekers such as heat seeking sensors or various guidance systems utilizing laser designators, etc. Such homing systems usually require sophisticated sensory devices that occupy relatively large spaces onboard and require relatively high onboard power to operate, which make them unsuitable for many munitions applications, particularly gun-fired munitions (particularly small and medium caliber munitions) and mortars. In addition, homing systems using various target designators such as laser target designator generally requires a forward target observer, usually a human, to designate the target, which is also not a desirable solution.

A need therefore exists for a method and apparatus that can be used to significantly increase the precision with which a target position can be provided to guide guided munitions without requiring aforementioned homing systems or the like seekers.

An object of the present invention is to provide such a method and apparatus that can be used in munitions, particularly in gun-fired munitions and mortars, to provide significantly higher precision with which the position of the target is provided to munitions for guidance to intercept a designated target.

Another object of the present invention is to provide a method and apparatus that provides higher target position precision to guided munitions without requiring onboard seekers.

Another object of the present invention is to provide a method and apparatus that provides higher target position precision to guided munitions using the aforementioned polarized RF position and orientation sensors and polarized RF sources such that not only the position of the target becomes known to guided munitions during their flights but information is also provided to the guided munitions as to their orientation relative to the target. The latter orientation information is essential for munitions guidance and control, since by knowing its orientation relative to the target at all times, the guided munitions can perform its guidance maneuvers with minimal control actuation efforts, thereby requiring smaller actuation devices and less power for guidance and control. As a result, less volume will need to be occupied by the latter components, thereby making it possible to provide guidance and control components to munitions without degrading their effectiveness, particularly for smaller caliber munitions.

SUMMARY OF THE INVENTION

Accordingly, a method for determining a position of a device in a reference coordinate system is provided. The method comprising: receiving, at the device, less than all of GPS signals necessary to determine the position of the device in the reference coordinate system; transmitting a signal from av illuminating source defined in the reference coordinate system; receiving the signal at a cavity waveguide disposed on the device; and determining the position of the device in the reference coordinate system based on the GPS signals and the signal received in the cavity waveguide.

The determining can determine a distance from a source of each of the GPS signals and illuminating source to the device and can determine the position of the device based on the distances.

The reference coordinate system can be the earth.

The signal from the illuminating source can be a polarized RF signal. The determining can determine a distance from a source of each of the GPS signals to the device and one or more of a distance from the illuminating source to the device and an angle between the device and the polarized RF signal from the illuminating source.

Also provided is a method for determining a position of a device in a reference coordinate system. The method comprising: receiving, at the device, GPS signals necessary to determine the position of the device in the reference coordinate system; determining the position of the device using the GPS signals; transmitting a signal from an illuminating source defined in the reference coordinate system; receiving the signal at a cavity waveguide disposed on the device; and confirming the position of the device in the reference coordinate system using the signal received in the cavity waveguide.

The determining can determine a distance from a source of each of the GPS signals and the confirming can determine a distance from the illuminating source to the device.

The reference coordinate system can be the earth.

The signal from the illuminating source can be a polarized RF signal. The confirming can determine one or more of a distance from the illuminating source to the device and an angle between the device and the polarized RF signal from the illuminating source.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The polarized Radio Frequency (RF) reference sources and geometrical cavities as described in U. S. Pat. Nos. 6,724,341 and 7,193,556 and U.S. Patent Application Publication No. 2007/0001051, are hereinafter referred to as "polarized RF position and angular orientation sensors", and "scanning polarized RF reference sources" described in the U.S. patent application Ser. No. 11/888,797 filed on Aug. 2, 2007, now U.S. Pat. No. 8,164,745, and Ser. No. 12/191,295 filed on Aug. 13, 2008, now U.S. Pat. No. 8,259,292, and hereinafter are referred to as "RF reference sources" are used to form an integrated target designation and reference source system for high precision guidance of guided munitions towards its target.

The aforementioned "polarized RF position and angular orientation sensors" and "polarized RF reference sources" (such as the aforementioned scanning type of polarized RF reference sources) are used to form a integrated target designation and reference source system for high precision guidance of guided munitions towards its target.

Figure 1:
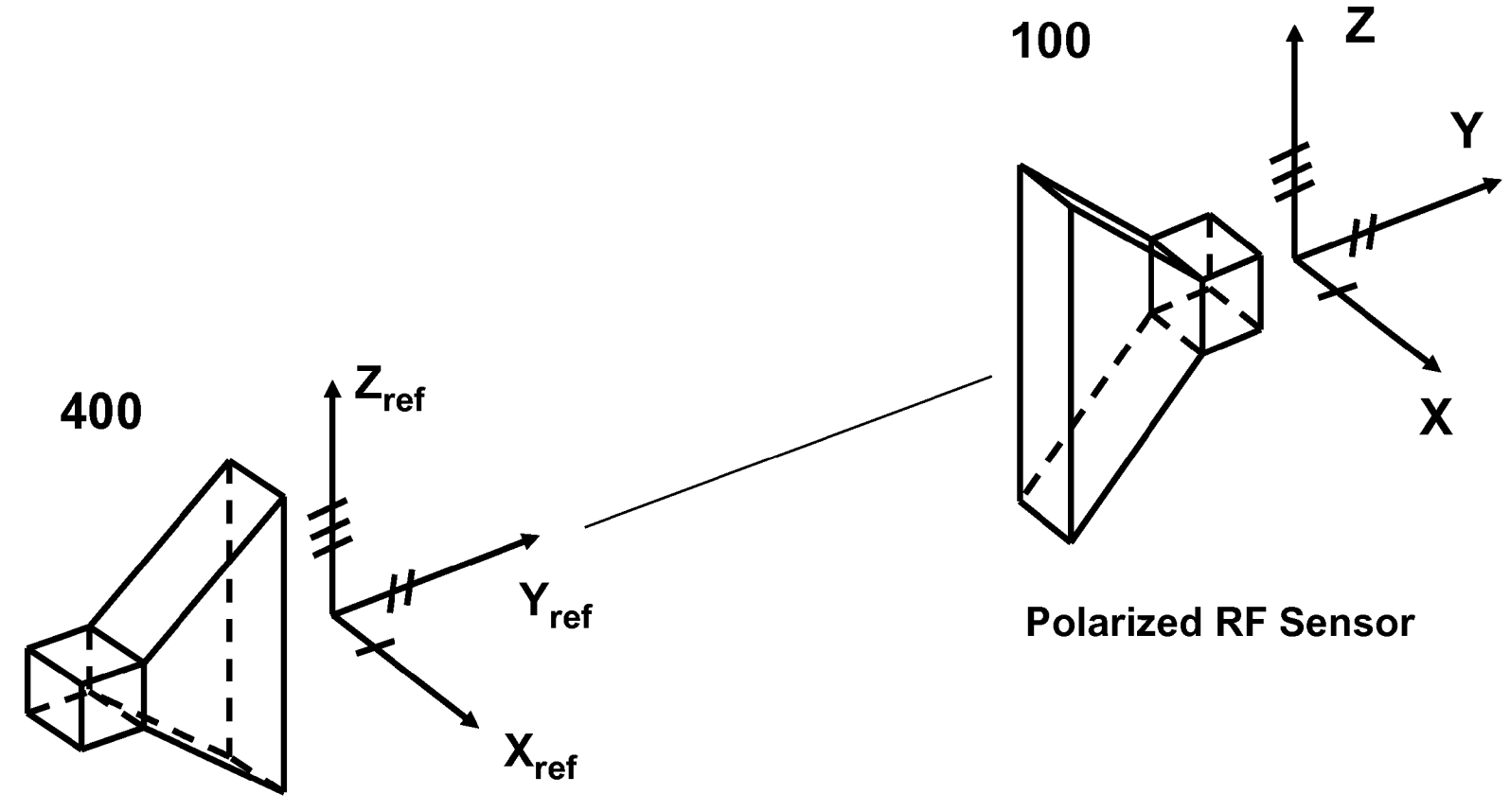
FIG. 1 illustrates an autonomous onboard absolute position and orientation measurement system (sensor) illustrating a polarized RF cavity sensor and a polarized RF reference source.

For example, FIG. 1 illustrates a polarized RF position and angular orientation sensor 100 considered to be embedded in the moving object (in this case a guided munitions in flight) and an RF polarized reference source 400. Although one of each is illustrated in FIG. 1, two or more are utilized. The position and orientation of the polarized RF reference sources 400 is considered to be known in the Cartesian coordinate system $X_{ref}Y_{ref}Z_{ref}$, which can be fixed to at least one of the polarized RF reference sources 400. The Cartesian coordinate system XYZ is considered to be fixed to the moving object (in this case a guided munitions in flight). The position and orientation of the polarized RF position and orientation sensors 100 are therefore known in the Cartesian XYZ coordinate system.

As described in the aforementioned U. S. Pat. Nos. 6,724,341 and 7,193,556 and U.S. Patent Application Publication No. 2007/0001051, by positioning at least three such polarized RF position and orientation sensors 100 on a first object and three such polarized RF reference sources 400 on a second object (forming a reference coordinate system $X_{ref}Y_{ref}Z_{ref}$), the full position and orientation of the first object can be determined relative to the second object, i.e., the position and orientation of the first object can be described fully in the reference coordinate system $X_{ref}Y_{ref}Z_{ref}$.

Figure 2:
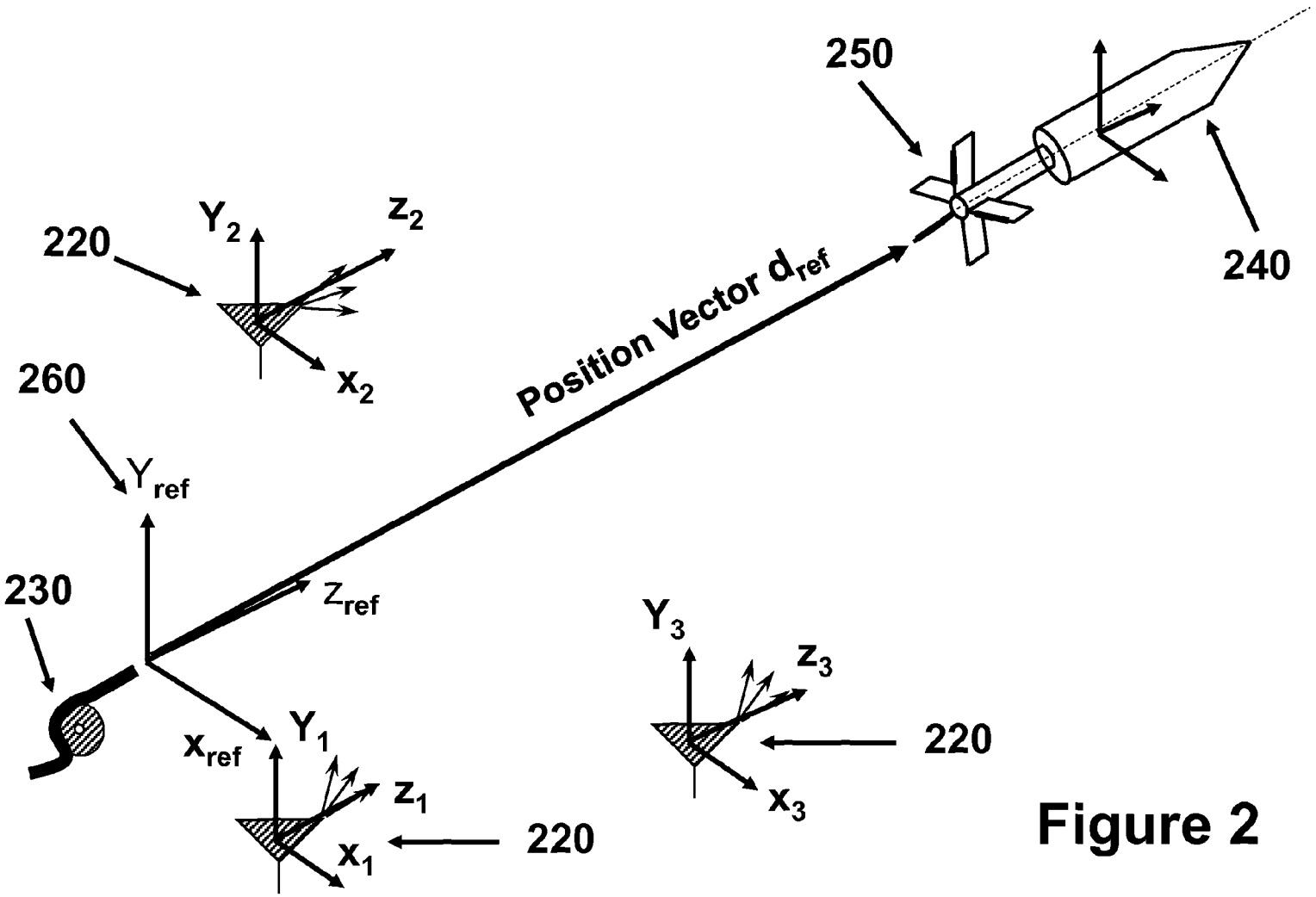
FIG. 2 illustrates an embodiment of an autonomous onboard absolute position and orientation measurement system, illustrating a plurality of polarized RF reference sources, shown surrounding a first object (in this case the fixed gun emplacement), to provide temporally synchronized, pulsed or continuous polarized RF reference signals to illuminate a second object (in this case a munitions in flight), on which a plurality of polarized RF cavity sensors are embedded (fixed) for providing on-board information about the position and orientation of the second object (munitions in flight) relative to the first object (the fixed gun).

FIG. 2 illustrates a basic method of using the aforementioned polarized RF reference source and polarized RF cavity sensors (also referred to as waveguide cavity sensors) for onboard measurement of full position and angular orientation of one object relative to another object. In this method, three or more of the polarized RF reference sources 220, which can be pulsed, provides reference signals, that can be temporally synchronized, that illuminate an object (in this case a projectile such as a munitions 240). A minimum of three polarized RF reference sources 220 is required though a greater number increases the accuracy of the onboard position and orientation calculations. A reference coordinate system (in this case a Cartesian coordinate system $X_{ref}Y_{ref}Z_{ref}$, indicated as 260 in FIG. 2) can be used, relative to which the position of each polarized RF reference source 220 and the position and orientation of the first object (in this case the gun 230) is known. Three or more polarized RF cavity sensors 250 are embedded in the second object (in this case the projectile 240). The full position and orientation of the second object (the projectile 240) can then be determined onboard the second object 240 relative to the first object (in this case the gun 230). That is, the full position and orientation of the second object 240 (in this case the projectile 240) can be determined onboard the second object 240 in the Cartesian coordinate system $X_{ref}Y_{ref}Z_{ref}$ as described in the aforementioned patents and patent application.

The Cartesian coordinate system $X_{ref}Y_{ref}Z_{ref}$ may be fixed to the first object (in this case the gun 230) as shown in FIG. 2, or in certain cases it may be preferable that it is not fixed to the first object 230 but be fixed to the earth, in which case the first object is essentially the earth.

When the above polarized RF reference sources and onboard polarized RF cavity sensors are used to guide a projectile 240 to intercept a target (the position of which is known in the Cartesian coordinate system $X_{ref}Y_{ref}Z_{ref}$), then the aforementioned first object is the Cartesian coordinate system $X_{ref}Y_{ref}Z_{ref}$ or whatever object (usually the earth) to which the Cartesian coordinate system is attached. In general, the reference Cartesian coordinate system $X_{ref}Y_{ref}Z_{ref}$ is considered fixed to the earth since as it was indicated previously, in most current munitions guidance and control systems, the position of the target is determined by a "forward observer" relative to the earth. It is noted that the "forward observer" may be a ground or airborne human observer, a UAV, a UGV, a satellite, or the like. In addition, the position of the weapon platform and the position of the guided munitions are also indicated relative to the earth, i.e., in the reference Cartesian coordinate system $X_{ref}Y_{ref}Z_{ref}$. During the flight, the guidance and control system onboard the munitions would then use the target position information and its own position measurement (both in the reference Cartesian coordinate system $X_{ref}Y_{ref}Z_{ref}$—in this case fixed to the earth) to navigate to intercept the target.

As was previously indicated, a first positioning error exists in the measurement of the position of the "forward observer" in the reference Cartesian coordinate system $X_{ref}Y_{ref}Z_{ref}$, in this case fixed to the earth. A second position error exists in the measurement of the position of the target in the reference Cartesian coordinate system $X_{ref}Y_{ref}Z_{ref}$. A third position error exists in the measurement of the position of the polarized RF reference sources in the reference Cartesian coordinate system $X_{ref}Y_{ref}Z_{ref}$. A fourth position error also exists in the measurement of the position of the munitions during the flight in the reference Cartesian coordinate system $X_{ref}Y_{ref}Z_{ref}$. All these four position measurement errors add up as the navigation and guidance and control system onboard munitions calculates its position relative to the target that it is attempting to intercept.

An objective of the present invention is to provide a method and means of significantly reducing the aforementioned amount of error between the actual position of the target and the target position calculated onboard munitions.

In a first embodiment, one of the polarized RF reference sources 220 is fixed to the "forward observer" (for example, to the UAV or UGV used to determine the position of the target or to the device used by a human forward observer to determine the position of the target).

In general and for safety reasons, a UAV or UGV or other types of unmanned devices can be used for this purpose. By fixing one of the polarized RF reference sources 220 to the "forward observer", the position of the target in the reference Cartesian coordinate system $X_{ref}Y_{ref}Z_{ref}$ is measured in the coordinate system established by the polarized RF reference source 220 that is used together with at least two other polarized RF reference sources to establish the reference $X_{ref}Y_{ref}Z_{ref}$ Cartesian coordinate system itself. As a result;

1. The error in the measurement of the position of the polarized reference sources 220 relative to the earth (or any other object to which the reference Cartesian coordinate system $X_{ref}Y_{ref}Z_{ref}$ would otherwise be fixed to) is eliminated from the error between the actual position of the target and the target position calculated onboard munitions.
2. The error in the measurement of the position of the "forward observer" in the reference Cartesian coordinate system $X_{ref}Y_{ref}Z_{ref}$ is significantly reduced since the reference Cartesian coordinate system $X_{ref}Y_{ref}Z_{ref}$ is defined by the polarized RF reference sources 220, one of which is the polarized RF reference source 220 that is fixed to the "forward observer", thereby significantly reducing the error between the actual position of the target and the target position calculated onboard munitions.
3. The error in the measurement of the position of the target in the reference Cartesian coordinate system $X_{ref}Y_{ref}Z_{ref}$ is significantly reduced since the reference Cartesian coordinate system $X_{ref}Y_{ref}Z_{ref}$ is defined by the polarized RF reference sources 220, one of which is the polarized RF reference source 220 that is fixed to the "forward observer" which is used to measure the position of the target, thereby significantly reducing the error between the actual position of the target and the target position calculated onboard munitions.

As a result, the error between the actual position of the target and the target position calculated onboard munitions and used by the munitions guidance and control system to guide it to intercept the target is significantly reduced. As a result, the precision with which the target can be intercepted by the guided munitions is significantly increased.

It is also noted that another advantage of the above embodiment is that the position of the polarized RF reference sources 220 relative to the earth or the gun 230 does not need to be known. It is, however, more efficient and generally requires less munitions maneuvering if the position of the gun 230 relative to the reference Cartesian coordinate system $X_{ref}Y_{ref}Z_{ref}$, i.e., the polarized RF reference sources 220 is known, thereby allowing the fire control system of the gun 230 to fire the munitions towards the selected target as accurately as possible.

In a second embodiment, more than one "forward observers" are used, to each of which a polarized RF reference sources 220 is affixed. It is appreciated that any type of "forward observers" (for example, to the UAV or UGV or a human forward observer or the like) or their combinations may be employed for this purpose. In general and for safety reasons, however, it is preferable to use UAVs or UGVs or other types of unmanned devices for this purpose. By fixing more than one polarized RF reference sources 220 to more than one "forward observers", the position of the target in the reference Cartesian coordinate system $X_{ref}Y_{ref}Z_{ref}$ is measured more accurately in the coordinate system established by the said polarized RF reference sources 220 that together with the remaining polarized RF reference sources establish the reference $X_{ref}Y_{ref}Z_{ref}$ Cartesian coordinate system itself As a result, the second and third position measurement errors enumerated above for the first embodiment of the present invention are significantly further reduced. As a result, the error between the actual position of the target and the target position calculated onboard munitions and used by the munitions guidance and control system to guide it to intercept the target is significantly further reduced. As a result, the precision with which the target can be intercepted by the guided munitions is significantly increased.

In a third embodiment, at least three "forward observers" are used, to each of which a polarized RF reference source 220 is affixed. In this embodiment all polarized RF reference sources used to establish the reference Cartesian coordinate system $X_{ref}Y_{ref}Z_{ref}$ are the above polarized RF reference sources 220 that are fixed to the "forward observers". It is appreciated that any type of "forward observers" (for example, to the UAV or UGV or a human forward observer or the like) or their combinations may be employed for this purpose. In general and for safety reasons, UAVs or UGVs or other types of unmanned devices can be used for this purpose. By fixing all the polarized RF reference sources 220 to the "forward observers", the position of the target in the reference Cartesian coordinate system $X_{ref}Y_{ref}Z_{ref}$ is measured very accurately in the coordinate system established by the polarized RF reference sources 220. In addition, the second and third position measurement errors enumerated above for the first embodiment are no longer important in the onboard munitions calculation of the error between the actual position of the target and the target position calculated onboard munitions and used by the munitions guidance and control system to guide it to intercept the target. In fact, the latter error is reduced to the level at which "forward observer" can measure the position of the target in the reference Cartesian coordinate system $X_{ref}Y_{ref}Z_{ref}$ and that the munitions can measure its own position in the reference Cartesian coordinate system $X_{ref}Y_{ref}Z_{ref}$. In fact, since the latter two position measurements are made in the same reference Cartesian coordinate system $X_{ref}Y_{ref}Z_{ref}$, this embodiment acts as a homing device that can be used to guide munitions to the designated target. As a result, the precision with which the target can be intercepted by the guided munitions is even further increased.

In a fourth embodiment, either one of the aforementioned embodiments are used together with a GPS device that whenever available would provide position information to the gun 230 and/or polarized RF reference sources 220, and/or the "forward observers", and/or to the munitions 240 (FIG. 2). This position information is mostly redundant and is used to increase the precision with which the aforementioned position information and thereby the error between the actual position of the target and the target position calculated onboard munitions and used by the munitions guidance and control system to guide it to intercept the target are calculated. As a result, the precision with which the target can be intercepted by the guided munitions is even further increased.

In a fifth embodiment, either one of the aforementioned embodiments is used together with onboard inertial sensors such as accelerometers and/or gyros to provide added position and/or orientation measurements, particularly at high rates for flight control. These inertial devices are periodically initialized by the onboard munitions measurements of its position and orientation by the onboard polarized RF sensors (the position initialization may also be complemented by the GPS when it is available) to correct for the accumulated errors in their measurements. The position and/or orientation information provided by the above inertial devices are mostly redundant and are used to increase the precision with which the aforementioned position and/or orientation information and thereby the error between the actual position of the target and the target position calculated onboard munitions and used by the munitions guidance and control system to guide it to intercept the target are calculated. As a result, the precision with which the target can be intercepted by the guided munitions is even further increased.

In many field scenarios, such as near mountains and or close to high metal structures or buildings or the like, the GPS receiver used on a weapon platform, UGV, polarized RF reference source, on target designator platform or personnel, or the like for determining their position may not receive at least four satellite signals to calculate its position. In certain situations, one or more such GPS signals may have been jammed or is otherwise unavailable for the GPS to determine its position on the ground or even when airborne. In such situation, the signal from at least one of the (fixed or mobile) polarized RF reference sources 400, FIG. 1, may be used together with the available GPS satellite signals to determine the position of the device. Such a device, hereinafter referred to as a "hybrid GPS device," is provided with at least one of the aforementioned polarized RF cavity sensors (100 in FIG. 1) that can be used as a position and/or orientation sensor to be used together with the available one or two GPS satellite position information to determine the position of the "hybrid GPS device."

Figure 3:
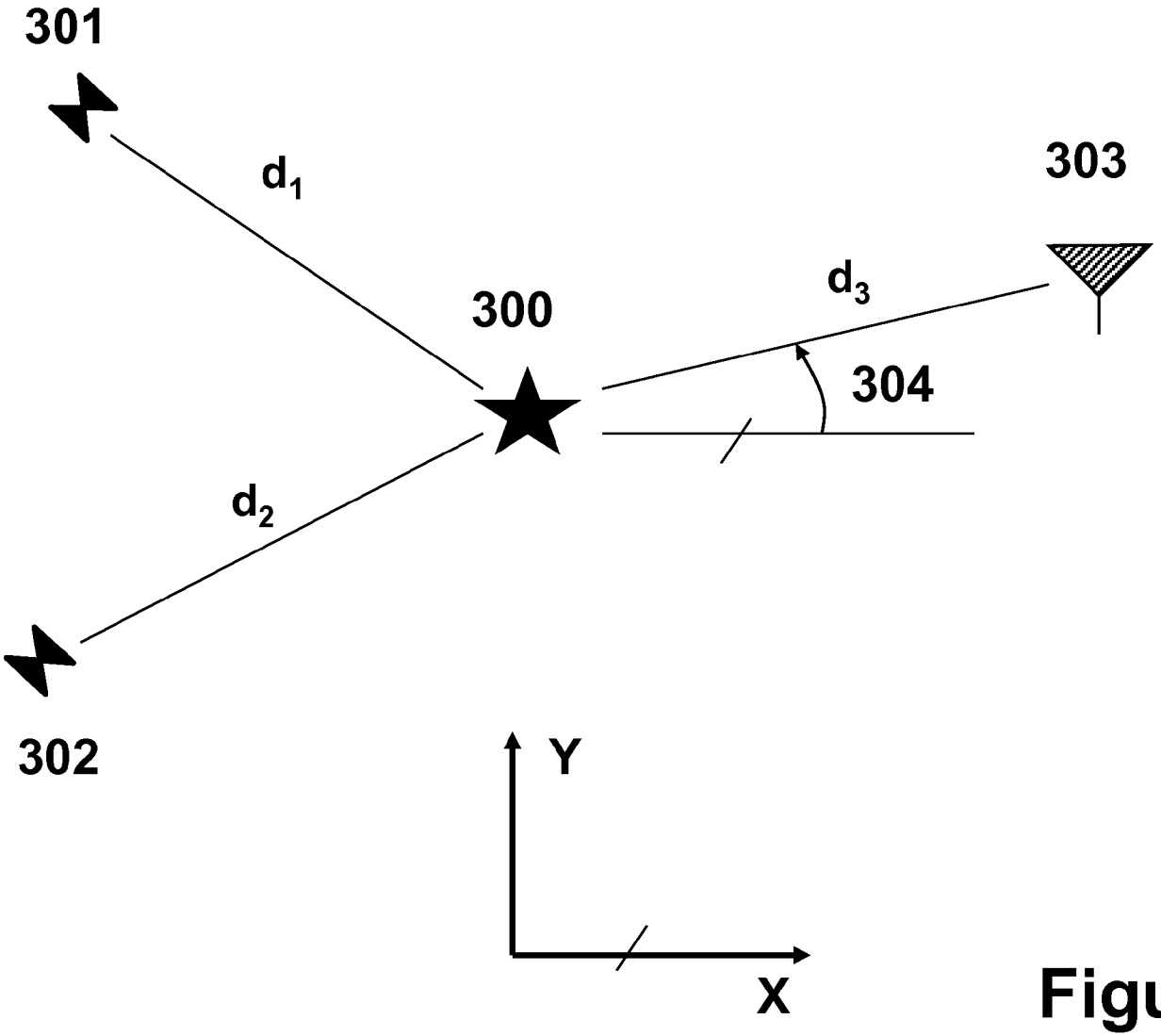
FIG. 3 illustrates another embodiment for onboard absolute position and orientation measurement system when the GPS signal is only partially available or if its position measurement is desired to be made more precise by at least one polarized RF cavity sensor and at least one polarized RF reference source.

As an example, consider the case in which signal from two GPS satellites 301 and 302 are available at the "hybrid GPS device" 300 shown in FIG. 3. The "hybrid GPS device" 300 can thereby calculate its distance to the two satellites 301 and 302. At least one polarized RF reference source 303 is also considered to be available. The "hybrid GPS device" 300 is also considered to be equipped with at least one aforementioned polarized RF cavity sensor (similar to 100 shown in FIG. 1—not shown in FIG. 3). The "hybrid GPS device" 300 can therefore use the signal received from the at least polarized RF reference source 303 to find its distance from the polarized RF reference source 303. Then, since the position of the satellites 301 and 302 relative to earth as well as the position and orientation of the at least polarized RF reference source 303 relative to the fixed (earth fixed) XY coordinate system are known, the point of intersection between the spheres with radii $d_1$, $d_2$ and $d_3$, i.e., the position of the "hybrid GPS device" 300 relative to the earth and the XY coordinate system, can be readily calculated.

It is noted that since the position and orientation of the polarized RF reference source 303 in the aforementioned XY coordinate system is known, the polarized RF cavity sensor of the "hybrid GPS device" 300 can be used to determine the angle 304, i.e., the angle that the line connecting the polarized RF reference source 303 to the "hybrid GPS device" 300 makes with, i.e., the X-axis of the XY coordinate system as shown in FIG. 3. Thereby, the "hybrid GPS device" 300 could use the angle 304 information instead of the distance $d_3$ to determine its position relative to the earth and the XY coordinate system. The use of the angular orientation in certain situations yields more accurate information since the distance $d_3$ measurement could be more readily measured by the polarized RF cavity sensor onboard the "hybrid GPS device" 300. When both angle 304 and the distance $d_3$ are measured by the polarized RF cavity sensor onboard the "hybrid GPS device" 300, both information may be used to increase the "hybrid GPS device" 300 position measurement precision.

It is appreciated by those skilled in the art that non-polarized RF reference source may also be used in place of the polarized RF reference source 303 with an RF signal receiver onboard the "hybrid GPS device" 300 for the measurement of the distance $d_3$, FIG. 3. The disadvantage of such a choice, however, is that with this option, the angle 304 cannot be measured and used independent of the distance $d_3$ measurement or together with the distance $d_3$ measurement to increase the precision of the "hybrid GPS device" 300 position measurement.

In another embodiment, the "hybrid GPS device" 300 with a GPS receiver and at least one polarized RF cavity sensor and at least one polarized RF reference source 303 is used as shown in FIG. 3. The GPS device is considered to have available good reception so that the GPS receiver alone can determine the position of the "hybrid GPS device" 300 relative to the earth within the GPS system precision. Then, the at least one position (distance $d_3$) and orientation (angle) measurement 304 are used to further increase the precision with which the position and orientation of the "hybrid GPS device" 300 is determined by providing at least one such more precise position and/or orientation measurement.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for determining a position of a device in a reference coordinate system, the method comprising:

receiving, at the device, some, but not all GPS signals necessary to determine the position of the device in the reference coordinate system;

transmitting a signal from an illuminating source defined in the reference coordinate system;

receiving the signal at a cavity waveguide disposed on the device; and determining the position of the device in the reference coordinate system based on the GPS signals and the signal received in the cavity waveguide.

2. The method of claim 1, wherein the determining determines a distance from a source of each of the GPS signals and a distance from the illuminating source to the device and determines the position of the device based on the distances.

3. The method of claim 1, wherein the reference coordinate system is the earth.

4. The method of claim 1, wherein the signal from the illuminating source is a polarized RF signal.

5. The method of claim 4, wherein the determining determines a distance from a source of each of the GPS signals to the device and one or more of a distance from the illuminating source to the device and an angle between the device and the polarized RF signal from the illuminating source.

6. A method for determining a position of a device in a reference coordinate system, the method comprising:

receiving, at the device, all GPS signals necessary to determine the position of the device in the reference coordinate system;

determining the position of the device using the GPS signals;

transmitting a signal from an illuminating source defined in the reference coordinate system;

receiving the signal at a cavity waveguide disposed on the device; and confirming the position of the device in the reference coordinate system using the signal received in the cavity waveguide.

7. The method of claim 6, wherein the determining determines a distance from a source of each of the GPS signals and the confirming determines a distance from the illuminating source to the device.

8. The method of claim 6, wherein the reference coordinate system is the earth.

9. The method of claim 6, wherein the signal from the illuminating source is a polarized RF signal.

10. The method of claim 9, wherein the confirming determines one or more of a distance from the illuminating source to the device and an angle between the device and the polarized RF signal from the illuminating source.

* * * * *